US005105859A

United States Patent [19]

Bennett et al.

[11] Patent Number: 5,105,859

[45] Date of Patent: Apr. 21, 1992

[54] TIME FLOW VOLUMETRIC LIQUID FILLING MACHINE

[75] Inventors: Richard N. Bennett, Sykesville; Donald E. Lanigan, Ellicott City, both of Md.

[73] Assignee: National Instrument Company, Baltimore, Md.

[21] Appl. No.: 519,726

[22] Filed: May 7, 1990

[51] Int. Cl.[5] ..... B67C 3/20; B65B 3/04

[52] U.S. Cl. ..... 141/102; 141/103; 141/177; 141/188; 141/237; 222/639

[58] Field of Search ..... 141/102, 103, 100, 234, 141/235, 236, 237, 242-244, 177, 188, 95, 96, 129; 222/638-641

[56] References Cited

U.S. PATENT DOCUMENTS

| | | | |
|---|---|---|---|
| Re. 23,830 | 5/1954 | Mojonnier | 222/641 X |
| 1,743,304 | 1/1930 | Angell | 141/1 |
| 2,559,242 | 7/1951 | Boegly et al. | 141/188 X |
| 2,880,912 | 4/1959 | Fisher | 222/640 X |
| 3,036,604 | 5/1962 | Donofrio | 141/242 X |
| 3,145,741 | 8/1964 | Smith | 222/641 X |
| 3,587,677 | 6/1971 | King | 141/177 X |
| 3,648,741 | 3/1972 | Crowsdale et al. | 141/9 |
| 3,651,836 | 3/1972 | Johnson | 141/103 |
| 3,702,625 | 11/1972 | Schmidt | 141/103 X |
| 4,208,852 | 6/1980 | Pioch | 141/243 X |
| 4,749,008 | 6/1988 | Whitney et al. | 141/103 X |
| 4,895,193 | 1/1990 | Rangwala et al. | 141/103 X |
| 4,951,719 | 8/1990 | Wiley et al. | 141/129 X |
| 4,953,751 | 9/1990 | Shannon | 222/641 X |

FOREIGN PATENT DOCUMENTS

| | | | |
|---|---|---|---|
| 2534554 | 2/1977 | Fed. Rep. of Germany | 141/103 |

*Primary Examiner*—Henry J. Recla
*Assistant Examiner*—Casey Jacyna
*Attorney, Agent, or Firm*—Barnes & Thornburg

[57] ABSTRACT

A filling machine including a manifold having a supply inlet and supply outlet and one or more nozzles connected to the manifold by individual time controlled valves. A circulation system is provided connecting a supply and the manifold for continuously circulating liquid through the manifold from the supply inlet to overflow the supply outlet such that the supply outlet determines the liquid level in the manifold and the head pressure at one or more nozzles. The manifold is structured to have a manifold section with a supply inlet on the manifold section and a stand pipe connected to the manifold section. The stand pipe includes the supply outlet and is vented to atmosphere. By varying the height of the stand pipe or the location of the outlet, the level within the manifold and the head pressure at the nozzles is adjusted. For sequential filling, bulk fill nozzles are controlled by a single timer and one or more fine fill nozzles are controlled by individual timers.

24 Claims, 2 Drawing Sheets

TIME FLOW VOLUMETRIC LIQUID FILLING MACHINE

BACKGROUND AND SUMMARY OF THE INVENTION

The present invention relates generally to filling machines and more specifically to a time flow filling machine for filling containers with a predetermined amount of fluid product.

In the past, filling machines for filling containers with a predetermined amount of fluid product generally utilized positive displacement units of the type described in U.S. Pat. Nos. 3,911,976; 4,004,620; 4,083,389 and 4,294,294. A separate filling unit was associated with each nozzle so that, for example, eight such positive displacement units were used in an eight nozzle machine. An appropriate indexing system would control the movement of the container relative to the nozzles.

Another type of filling machine is known as the constant time-pressure principle. In these machines, the dispensed amount of fluid product is determined by the length of time the valve remains open. Since feed of the fluid product is under constant pressure, the amount dispensed is directly proportional to time. One constant pressure device includes a supply tank being kept under constant pressure by compressed gas, for example. It is costly to maintain the pressure sufficiently constant and eliminate completely fluctuations in pressure which would adversely affect the accuracy of the amount of fluid dispensed.

Other time flow devices are gravity time flow devices using the pressure head of the fluid product in the supply reservoir to the nozzles. For a constant pressure, the liquid level within the supply reservoir must be maintained constant. With fluctuation of the amount of fluid in the reservoir during the dispensing cycle, the flow rate is uneven.

Similarly in the time flow devices, adjustment of the nozzle for various height containers to be transported thereunder changes the distance between a fixed-height supply tank and the nozzle. This changes the head pressure since there is a change in distance between the top of the liquid level in the supply tank and the discharge point of the nozzle. With fixed-height gravity flow tanks, the only way to increase the nozzle flow rate is by means of a pressurized tank or by raising the entire supply tank. This is not only inconvenient but inaccurate.

Time flow systems generally included individual timers for each nozzle to allow adjustment for variations of the characteristics of the nozzle. Set up is very time consuming, especially when each nozzle fills a single container. The adjustment of the timer for one nozzle affects the flow rate of the other nozzles. Therefore, each nozzle must be adjusted and readjusted as other nozzles are adjusted. To avoid these variations, it has been suggested that each of the nozzles be used to fill a portion of a container in a sequence. A typical example is illustrated in U.S. Pat. No. 3,651,836. A first timer is used for one set of nozzles while a second timer is used for a second set of nozzles. In the example given, each of four nozzles fill ¼ of the total volume into each container.

In certain situations where an exact amount of dispensing is required, a flow meter may be used connected to a pressurized reservoir as illustrated in U.S. Pat. No. 4,401,141. Even further types of filling machines include filling to a desired level using a level sensing device with a fill rate and dribble or top-off rate. These level sensing devices generally fill one container at a time completely or a group of containers using individual control systems. Thus they are very expensive.

Thus it is an object of the present invention to provide an inexpensive time flow, gravity filling machine.

Another object of the present invention is to provide a time flow, gravity filling machine having a constant flow rate despite adjustment for container height.

A still even further object of the present invention is to provide a time flow, gravity filling machine wherein the flow rate for all the bulk fill nozzles can be adjusted simultaneously.

An even further object of the present invention is to provide an inexpensive time flow filling machine with increased accuracy.

Still a further object of the present invention is to increase the throughput of a filling machine while increasing or maintaining accuracy of fill.

Another object of the present invention is to decrease the amount of time required to adjust the machine to dispense a given fill size.

These and other objects are attained by providing a manifold having a supply inlet and supply outlet and one or more nozzles connected to the manifold by individual time controlled valves. A circulation system is provided connecting a supply and the manifold for continuously circulating fluid through the manifold from the supply inlet to the supply or overflow outlet such that the supply outlet determines the fluid level in the manifold and the head pressure at one or more nozzles. The manifold is structured to have a manifold section with a supply inlet on the manifold section and a stand pipe connected to the manifold section. The stand pipe includes the supply outlet and is vented to atmosphere. By varying the height of the stand pipe or the location of the outlet, the level within the manifold and the head pressure at the nozzles is adjusted. This can be varied by replacing the stand pipe with various length stand pipes or by providing an adjustable stand pipe having telescopic sections. A diffuser is provided at the supply inlet which is adjacent the Point at which the stand pipe is connected to the manifold section.

The machine includes a base having a conveyor mounted thereto for positioning containers under the nozzles. A carriage, mounted on the base to move vertically, has mounted thereon the manifold, the nozzles and the time controlled valves. Thus when the carriage is moved vertically for various sized containers, the head pressure at the nozzles does not change since the relationship between the manifold, nozzles and the controlled valves does not change. Substantially straight hoses connect the manifold, the valves and the nozzles so as to maintain the fixed relationship between the fluids in these elements. The nozzles are mounted to the carriage so as to be adjustable in a horizontal plane.

The circulation system includes a pump mounted to the base. A tank, also mounted to the base, may contain fluid to be dispensed. A source of compressed gases and the manifold may be connected to the tank with the supply outlet and vent of the stand pipe closed such that the filling machine may be operated as a pressure, time flow versus a gravity, time flow system. The pump and a level sensor could be used to replenish the tank. The base includes a horizontal frame with a first vertical frame to which the track is mounted and a second vertical frame member to which the carriage mounted. The nozzles are spaced along the longitudinal axis of the manifold which is parallel to track. Each of the nozzles and its respective time controlled valve lie in a plane orthogonal to the longitudinal axis of the manifold.

The controller for the prior art filling machines may include a single timer providing time control to each of the nozzles wherein each of the nozzles fills completely a single container. An indexing system then indexes the same number of containers as there are nozzles. This is in contrast to the present sequential filler where each container would receive a portion of the total fill volume from each of the respective nozzles. In the sequential filling, a single timer would be used for all the bulk fill nozzles except the last nozzle which would be a top-off or fine fill nozzle. This fine fill nozzle has its own separate timer.

For increased throughput, more than one container is indexed in each cycle. For each of the containers to be indexed in a single cycle, a group of bulk fill nozzles and a fine fill nozzle are provided. While each group of the bulk fill nozzles may use a common group timer or its own group timer, each fine fill nozzle requires its own timer.

The amount of fluid dispensed by the fine fill nozzle can be a smaller amount by controlling the time or a different rate by restriction within the nozzle or a combination of both. If desired, the fine fill nozzle can be a level sensing nozzle instead of time flow nozzle. As even a further alternative, it may be desirable to have a sinusoidal dispensing across the longitudinal axis of the manifold. To achieve this, each of the nozzles would have different timers or different flow rates. It is preferred to use a single timer in combination with flow restrictor to achieve different flow rates. The sinusoidal delivery would match the delivery of a single metering device, for example a crank driven piston pump.

Other objects, advantages and novel features of the present invention will become apparent from the following detailed description of the invention when considered in conjunction with the accompanying drawings.

DETAILED DESCRIPTION OF THE DRAWINGS

Figure 1:
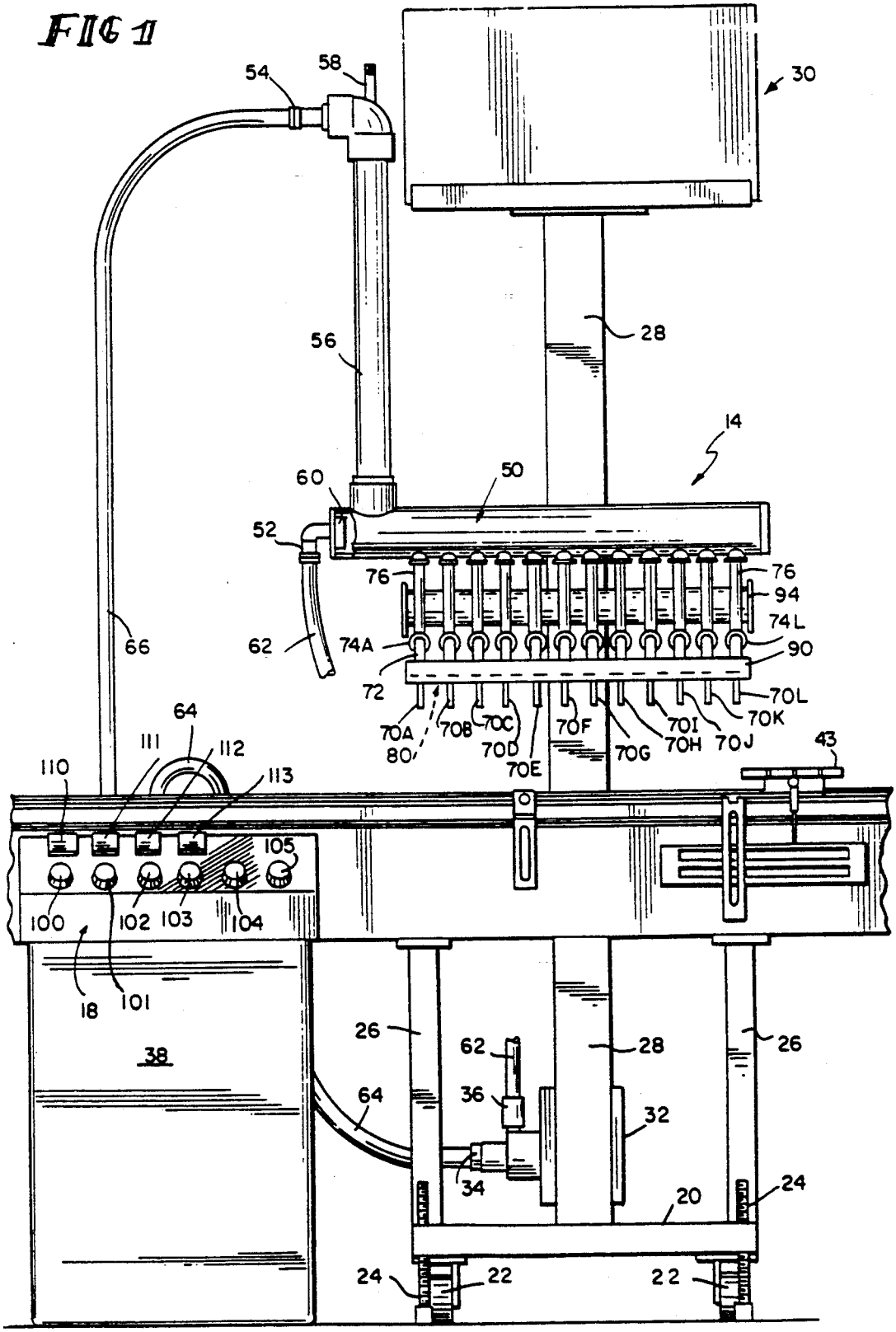
FIG. 1 is a front view illustrating a filling machine incorporating the principles of the present invention.

A filling machine 10, as illustrated in the figures, includes a base 12 having a filling unit 14, a conveyor system 16 and a control unit 18.

The base 12 includes a horizontal frame member 20 having a pair of first vertical frame members 26 to which is connected the conveyor system or track 16 and the control unit 18 and a second rear vertical frame member 28 to which is mounted the filling unit 14. Wheels 22 are provided on the horizontal frame member 20 as are leveling bolts 24. A supply tank 30 is mounted to the vertical frame member 28 as is a pump 32 having an inlet 34 and an outlet 36. A large external supply 38 is also illustrated.

Figure 2:
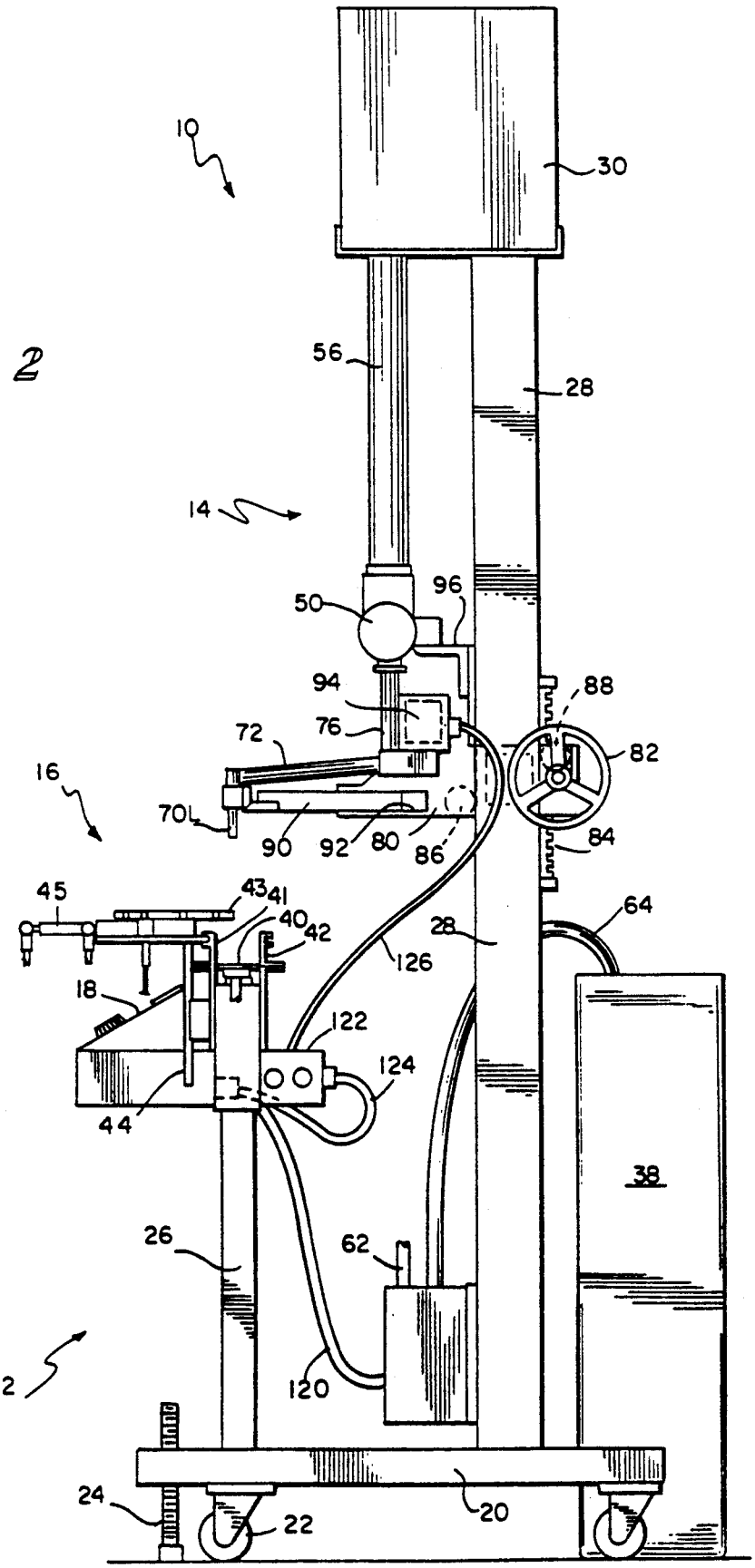
FIG. 2 is a right side view of the filling machine according to FIG. 1.

As illustrated in FIG. 2, the conveyor 16 includes a belt 40 between a channel having walls 41 and 42. An escapement, illustrated as a star wheel 43, is mounted to the conveyor housing walls by an unadjustable connection at 44. A lock 45 for the star wheel 43 is under the control of the control unit 18. The specific structure of the star wheel 43 and its operating control is well know and may include those of any of the patents discussed in the background of the invention. Further details of the conveyor 16 have not been provided for sake of clarity since they are well know in the prior art.

The filling unit 14 includes a manifold 50 having a supply inlet 52, a supply outlet 54 and a stand pipe 56 connected to the manifold 50. The stand pipe 56 is vented to atmosphere at vent 58 and is connected to the manifold adjacent the supply inlet 52. A liquid diffuser 60, provided at the supply inlet 52 of the manifold, prevents the velocity head of the incoming fluid stream from creating a Venturi effect along the longitudinal axis of the manifold 50. This would effect the flow rate of the nozzles connected to the manifold 50. The supply inlet 52 of the manifold 50 is connected by hose 62 to the outlet 36 of the pump 32. The inlet 34 of the pump 32 is connected to the supply 38 by hose 64. The supply outlet 54 of the stand pipe 56 is connected by tubing 66 to the supply 38.

The pump 32 pumps the fluid to be dispensed from supply 38 through the supply inlet 52 of the manifold 50 up the stand pipe 56 to be returned through supply outlet 54 to the supply 38. By pumping the fluid at a higher rate than it can be dispensed, liquid will always overflow the supply outlet 54 and the liquid level within the manifold 50 and stand pipe 56 will always be constant. Vent 58 at the top of the stand pipe 56 maintains the manifold 50 and stand pipe 56 at a substantially atmospheric pressure and therefore will not be subject to any variation in the output of the pump 32.

Although a closed manifold 50 with a stand pipe 56 is shown, the overflow principle to maintain a constant liquid level in the manifold is applicable to other designs. For example, the manifold 50 may be an open tank with an adjustable weir defining the level of overflow and thus the level in the manifold and some liquids may not be able to be recirculated and therefore the overflow would not be returned to the source. Also the source of liquid to the manifold 50 could be a gravity tank such as supply tank 30, where the in flow rate is sufficient to maintain overflow during dispensing through the nozzles.

A plurality of nozzles 70A through 70L are connected to the manifold 50 by hoses 72, time controlled valves 74A through 74L and hoses 76. As shown in FIG. 2, a carriage 80 is mounted to the vertical frame member 28 by a rack 84 and a gear connected to hand wheel 82. A pair of rollers 86 and 88 balance and reduce the friction between the carriage 80 and the vertical frame member 28. A bracket 90 slides in an opening 92 of the carriage 80 and receives the nozzles 70A through 70L. This allows adjustment of the nozzles in a horizontal plane with respect to the position of the container on the track or conveyor system 16.

An enclosure 94 is the junction box for the time controlled valves 74 and is mounted to the carriage and extends along the longitudinal axis of the manifold 50. The time controlled valves 74 are mechanically and electrically connected to the electrical enclosure 94. The manifold 50 is connected to the carriage 80 by bracket structure 96.

As can be seen from FIG. 1, the time controlled valve 74 and it respective nozzle 70 are substantially in a common plane which is orthogonal to the longitudinal axis of manifold 50. This particular placement of the time controlled valve 74 and its electronics behind the nozzle 70 allows the nozzles to be closer together. This allows the system to handle narrower containers.

The manifold 50, stand pipe 56, nozzles 70, valves 74 and hoses 72, 76 contain the fluid and define the head at the nozzles 70. Since all these elements are mounted on a common bracket in fixed, geometrical relationships, the head, and therefore, the flow rate, remains constant throughout the vertical adjustment range of the carriage. Since the nozzles 70 do not move with respect to any other portion of the fluid dispensing system, the hoses 72 and 76 need not be flexible. Therefore bends or other restriction of tubes, which cause variations of flow rates, have been eliminated.

This fixed relationship between the manifold 50, stand pipe 56 and the connection through to the nozzles 70 and the level of fluid in that system being maintained constant by continuously circulating the fluid therethrough, guarantees a constant flow rate at the individual nozzles. Variation of the flow rate through the nozzles may be achieved by varying the position of the supply outlet 54. This can be achieved by removing the stand pipe 56 and inserting a different height stand pipe or making the stand pipe 56 of telescopic elements such that the height of the stand pipe may be adjusted. Since the fluid is continuously circulating or overflowing, it is the height of the outlet 54 that determines the level of fluid within the manifold system and therefore the head pressure and the flow rate. The present principle is illustrated for a manifold having a plurality of nozzles, but it is also applicable to a manifold having a single nozzle. This system maintains the desired flow rate for one or more nozzles.

The flow rate between the various nozzles may be adjusted by either fixed or variable restriction at the nozzle 70, hoses 72 or 76 or the time control valve 74. The amount of fluid to be dispensed may be adjusted by varying the flow rate while keeping the timer constant, or providing different timers for equal flow rated nozzles, or a combination of restriction and different timers.

The control unit 18 includes the control electronics for the system and also a plurality of control knobs 100–105 and a plurality of displays 110–113. The control knobs 100–103 may control three separate distinct timers with their displays 110–113. Each display 110–113 displays the preset amount of time of a cycle of the timer and the running or present counter time within that cycle counting up or down. As will be explained more fully below, at least one timer must be provided for bulk fill nozzles and a separate timer for each fine fill nozzle. One of the displays and its associated knob and timer may be used to adjust other timed signals in the operation as is well known in the art. Also, the display and associated knob may be used to adjust and display other control variables other than timers. Control 104 may control, for example, the speed of the conveying system 16, the pump 32, the number of containers to be indexed by the star wheel 43 in a cycle, etc.

Knob 105 is a mode select. Two settings would be Off and Run. A third setting is Set Up, where the pump 32 is running with the valves closed. This primes the system. A fourth setting is Clean, where the pump is running with the valves open. The hoses 64 and 66 would be connected to a source of cleaning liquid and the nozzle 70 would be repositioned from over the conveyor 16 by sliding bracket 90, for example. The conveyor 16 may or may not be operational during either or both of the third and fourth settings.

As illustrated in FIG. 2, the control unit 18 is connected to the pump 32 by a wire 120. The connection of the control unit to the conveying system has been omitted for sake of clarity. The output of the timers is provided to a distribution box 122 by wires 124 and the distribution box 122 is connected to the electrical enclosure 94 by wires 126. The timer signals from the timers are provided to the individual time controlled valves at the enclosure 94. If more than one bank of manifolds, nozzles and controlled valves are provided along the conveyor system 16, the distribution box 122 will provide the appropriate time control signals to these other time control valves. This reduces the amount of timers needed. The timers are self-contained units with adjustable re-set. The control unit, 18, including the adjustable timers, on/off control of the pump, and the speed of the conveying system, is a consolidation of available control systems.

The time controlled valves 74 may be solenoid valves, pinch valves, pneumatic valves or other time controlled valves. If pneumatic valves are used, the appropriate air signal will be provided instead of the electric signals as illustrated.

It should be noted that the tank 30 may be provided and may be used in the present system to provide a gravity flow supply as previously described or a pressurized time flow system. In the pressurized mode of operation, the hose 62 is connected to the tank 30 and the outlet 54 of the stand pipe and the vent 58 are closed. A source of compressed gas would pressurize the tank 30. The pump 32, using a level sensor would replenish the tank 30 from a supply 38.

In some applications, the constant flow rate is undesirable. When dealing with foamy liquids, the flow rate must be reduced to a point where the foam level is acceptable and does not overflow. At high flow rates when the fill level gets close to the top, the fluid gushes out. With tapered or narrow-necked containers, the fill level in the container increases drastically as the fill approaches the top of the container, thereby imparting a high velocity head to the fluid and causes a "fountaining" effect. Thus the use of a single flow rate requires a reduction of the single flow rate and thus a reduction of throughput.

In addressing these problems, the present invention preferably provides a sequential filling system wherein a container receives liquid in sequence from more than one nozzle. This will allow a variation in the amount of fluid and the flow rate between the different nozzles. By providing two different timers, the nozzles 70A–70K will be bulk fill nozzles and the last nozzle 70L can be a fine fill nozzle providing substantially less fluid to the last container to top it off. Also, the flow rate through the last nozzle 70L may be decreased by including an appropriate restriction. The last nozzle 70L and its control valve 74, instead of being time controlled, may be a level sensing and control valve. Using the sequential fill, the star wheel 43 will only release one container at a time.

With the twelve illustrated nozzles 70A–70L, the star wheel 43 may be set to release two containers at a time and therefore each container would receive full flow or bulk fill from five alternate nozzles (70A, C, E, G, I or 70B, D, F, H, J) with the last two nozzles 70K and 70L providing the top off or fine fill to their respective alternate containers. The two groups of five bulk fill nozzles 70A–70J may be controlled by a single timer and each of the fine fill nozzles 70K and 70L is controlled by an individual timer. Thus the throughput has been doubled by the addition of only one timer. This allows the bulk fill nozzles to be set for maximum filling rate with the fine fill nozzles being set for accuracy of fill. As long as the bulk fill nozzles provide a repeatable amount per unit of time, they need not each provide any specific amount per unit of time. Only the fine fill timers need adjustment for accurate filling. If the two groups of bulk fill nozzles are dispensing different liquids, two bulk fill timers could be used.

This principle can be expanded to any number of containers to be indexed during one cycle. For each container indexed in a cycle, a separate fine fill nozzle and valve with a separate timer is provided in addition to the bulk fill timer. Thus for three containers per index, one bulk fill timer with three fine fill timers would be used. Using the example above with five bulk fill and one fine fill nozzle per container, the system would include 18 nozzles, 15 bulk fill and three fine fill. Fine fill nozzle 16 would top off containers filled by nozzles 1, 4, 7, 10 and 13. Fine fill nozzle 17 would top off containers filled by nozzles 2, 5, 8, 11 and 14. Fine fill nozzle 18 would top off containers filled by nozzles 3, 6, 9, 12 and 15. Thus, this system requires one bulk and three fine fill timers as compared to eighteen timers used in prior art systems.

In all embodiments of the present system, using single or multiple releases of containers by the escapement it is required that each container is filled in sequence by a specific set of bulk fill and fine fill nozzles. This eliminates any variation in bulk fill volume due to flow variations in individual bulk fill nozzles.

The sequential filling using a bulk fill timer for one or more nozzles and a fine fill timer for only a single nozzle may be used with other time fill systems other than the present gravity feed system. These would include other gravity feed systems as well as pressurized systems.

If a sinusoidal variation of the filling is desired, each of the nozzles 70A–70L may have different flow rates by various restriction. This would mimic the sinusoidal variation produced by a crank driven piston pump. Thus the upstream nozzles 70A and 70B and the down stream nozzles 70K and 70L, for example, would have substantial restrictions with the maximum flow being in the center nozzles 70E, F and G.

As discussed previously, an additional manifold 50 with banks of nozzles 70 may be provided and controlled by the common control 18.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A liquid filling machine comprising:

supply means for supplying liquid;

a first plurality of nozzles connected to said supply means by time controlled valves for dispensing the liquid during a dispensing period;

a first timer means for controlling two or more valves to be open a predetermined dispensing period of time;

a second timer means for controlling only a single last valve to be open a predetermined dispensing period of time; and conveyor means for positioning containers under each of said nozzles whereby liquid is dispensed from each of said nozzles during each dispensing period.

2. A machine according to claim 1 including a plurality of second timer means each controlling only a single valve.

3. A machine according to claim 2 wherein valves controlled by said second timer means are adjacent.

4. A machine according to claim 2 including a plurality of first timer means each controlling two or more valves.

5. A machine according to claim 4 including an equal number of first and second timer means.

6. A machine according to claim 2 wherein said conveying means moves a plurality of containers a predetermined number of nozzle positions between timer cycles; and wherein the number of second timer means equals said predetermined number.

7. A machine according to claim 2 wherein there is only one first timer means.

8. A machine according to claim 1 including a plurality of first timer means each controlling two or more valves.

9. A machine according to claim 1 wherein, the number of filled containers per operating cycle discharged from under said nozzles by said conveying means equals the number of second timer means.

10. A time flow filling machine comprising:

a manifold means, having a supply inlet, for holding liquid;

a plurality of nozzles connected to said manifold means;

a plurality of time controlled valve means for connecting a respective nozzle to said manifold means and spaced along a longitudinal axis of the manifold means;

a conveyor for positioning containers under each of said nozzles along said longitudinal axis;

control means having a first timer means for time control of two or more of the time controlled valve means to be open for a predetermined period of time and a second timer means for time control of at least time controlled valve means for a predetermined period of time; and circulation means connecting a supply of liquid and said manifold means for maintaining a predetermined level of liquid in said manifold means and corresponding head pressure at said nozzles.

11. A machine according to claim 10 wherein said manifold means includes:

a manifold having said supply inlet;

a stand pipe connected to said manifold, having a supply outlet, and being vented to atmosphere; and said circulation means continuously circulates said liquid through said manifold means from its supply inlet to its supply outlet thereby maintaining a predetermined level of liquid in said manifold means and corresponding head pressure at said nozzle.

12. A machine according to claim 11 including a diffuser at said supply inlet.

13. A machine according to claim 11 wherein said stand pipe is connected to said manifold adjacent said supply inlet.

14. A machine according to claim 10 including:

a base;

a conveyor mounted to said base for positioning a container under said nozzle;

a carriage mounted on said base to move vertically thereon; and said manifold means, nozzle and valve means being mounted to said carriage whereby adjusting said carriage does not effect said head pressure.

15. A machine according to claim 14 including a plurality of nozzles mounted on said carriage and connected to said manifold by a controlled valve.

16. A machine according to claim 15 including hoses connecting said manifold means to said valve means and said valve means to said nozzles.

17. A machine according to claim 15 including means for adjusting the horizontal position of said nozzles with respect to said conveyor.

18. A machine according to claim 14 including means to adjust said carriage vertically.

19. A machine according to claim 14 wherein said base includes a horizontal frame member;

a first vertical frame member to which said conveyor is mounted; and a second vertical frame member to which said carriage is mounted.

20. A machine according to claim 10 including position control means for controlling the position of the containers along the conveyor so that each container receives liquid from each of said nozzles during different cycles of the first and second timer means.

21. A machine according to claim 10 wherein said second timer means has a shorter time period than said first timer means.

22. A machine according to claim 10 wherein including control means for controlling said nozzles to provide a variable dispensing across said longitudinal axis.

23. A machine according to claim 22 wherein said control means includes different timer means for controlling said time controlled valve means.

24. A machine according to claim 10 wherein each nozzle and its respective valve means are in a plane orthogonal to said longitudinal axis of the manifold means.

* * * * *